US005842905A

United States Patent [19]

Lee et al.

[11] Patent Number: 5,842,905

[45] Date of Patent: Dec. 1, 1998

[54] PROCESS FOR MAKING A TEMPORARY COLOR CHANGE ON A PLASTIC MATERIAL

[75] Inventors: James S. W. Lee, Long Island, N.Y.; Chiu Keung Kwan, Kowloon, Hong Kong; Chiu Kien-Wan; Chen Kan-Nan, both of Taipei, Taiwan

[73] Assignee: C.J. Associates, Ltd., Kowloon, Hong Kong

[21] Appl. No.: 938,400

[22] Filed: Sep. 26, 1997

Related U.S. Application Data

[63] Continuation of Ser. No. 207,389, Mar. 8, 1994, abandoned, which is a continuation of Ser. No. 149,110, Nov. 9, 1993, abandoned, which is a continuation of Ser. No. 86,194, Jul. 1, 1993, abandoned, which is a continuation of Ser. No. 842,241, Feb. 26, 1992, abandoned.

[51] Int. Cl.[6] ..... A63H 3/44

[52] U.S. Cl. ..... 446/296; 446/394

[58] Field of Search ..... 446/296, 372, 446/394, 268, 491

[56] References Cited

U.S. PATENT DOCUMENTS

| | | | |
|---|---|---|---|
| 3,382,607 | 5/1968 | Ryan et al. | 446/394 |
| 4,276,207 | 6/1981 | Lester et al. . | |
| 5,083,967 | 1/1992 | Yokoe et al. | 446/394 |
| 5,346,422 | 9/1994 | Bagrodia . | |

FOREIGN PATENT DOCUMENTS

| | | | |
|---|---|---|---|
| 204986 | 11/1984 | Japan | 446/268 |

*Primary Examiner*—Robert A. Hafer
*Assistant Examiner*—Jeffrey D. Carlson
*Attorney, Agent, or Firm*—Laff, Whitesel, Conte & Saret, Ltd.

[57] ABSTRACT

A simple, general purpose temporary dyeing process for coloring plastic or plastic fabric is disclosed. A colorless, but pH sensitive indicator solution is applied to a plastic material, such as the hair of a fashion doll, without changing the hair color. A developer solution of a specific pH range is subsequently applied to the doll hair, thereby causing the color of the hair to change. As the hair dries and the developer solution evaporates, the hair returns to its original color.

12 Claims, 1 Drawing Sheet

PROCESS FOR MAKING A TEMPORARY COLOR CHANGE ON A PLASTIC MATERIAL

This application is a continuation of application Ser. No. 08/207,389, filed Mar. 8, 1994, now abandoned which in turn is a continuation of Ser. No. 08/149,110, filed Nov. 9, 1993, now abandoned which in turn is a continuation of Ser. No. 08/086,194, filed Jul. 1, 1993, now abandoned which in turn is a continuation of Ser. No. 07/842,241, filed Feb. 26, 1992, now abandoned.

FIELD OF THE INVENTION

This invention relates generally to processes for temporarily coloring plastic devices and, more particularly, to temporarily coloring plastic fabric such as doll hair.

BACKGROUND OF THE INVENTION

There are many times and places where it is desirable to color a plastic item for a short period of time and then to have the plastic revert to its original color. For example, one might have a sample carpeting made of a plastic fabric. The sample may have a neutral color which might be sprayed so that it becomes a different color long enough to view it against a background of furniture, drapes, and the like. Then the color may disappear as it evaporates or combines with a neutralizer so that the original neutral color reappears.

This type of temporary color change is especially attractive for use on toys. Any toy having a plastic surface could be temporarily dyed a different color. For example, a warrior doll wearing a plastic uniform could be sprayed to make the warrior wear a uniform that would look like the enemy's uniform so that the doll in the dyed uniform could infiltrate the enemy lines. Another example might be a plastic fabric-covered stuffed animal toy which could be dyed on a temporary basis to become another animal. For example a teddy bear might be sprayed to temporarily become a panda.

A specific example of a particular use for the inventive process is found in the hair coloring of a fashion doll. For example, the child who plays with the fashion doll might want to dye the plastic blond hair for a night out as a red head, say at a pretend "graduation ball", and then have its hair return to its original blond color after the ball is over.

U.S. Pat. No. 3,382,607 discloses a toy, such as a doll, having hair fibers which are capable of color change when treated with solutions of varying pH concentrations. The patent explains that acetate fiber is initially cleaned and then colored and impregnated with a dye solution. The fiber is soaked in the dye solution for at least fifteen minutes and at a bath temperature of approximately 125° F. As the fiber soaks in the dye solution, impregnation takes place. When the dyeing application is completed, the fiber is rinsed clean and subsequently soaked in a mild acid solution. After the fiber has been dried, it is ready for processing and use as doll's hair. In actual use, the child prepares a mild basic solution and rinses the doll's hair in it, thereby causing the color change. The hair will remain as this new color unless the child rinses the doll's hair with a mild acidic solution to reverse the reaction and restore the hair's original coloring.

Thus, the color change process disclosed in U.S. Pat. No. 3,382,607 requires that a number of steps be performed by the child, including mixing a basic solution in water before rinsing the doll's hair in it. Furthermore, the color change is permanent unless the child acts further to change the doll's hair back to its original color. This is accomplished by preparing a mild acid solution in water and then applying it to the doll's hair.

Therefore, it is an object of the invention to provide a simple, general purpose temporary dyeing process for coloring plastic, including plastic fabric and hair.

It is also an object of the invention to provide an easy process for temporarily coloring the hair of a fashion doll.

Furthermore, it is an object of the invention to provide a general purpose toy which may be modified by a child for creative play.

For convenience of expression, the term "untreated hair" is used herein to mean hair which, in order to undergo the temporary color change process of the invention, requires a child to treat the hair with an indicator solution. The term "pre-treated hair" is used herein to mean hair which has been impregnated with an indicator solution by the manufacturer, thereby eliminating the need to treat the doll's hair with an indicator solution.

SUMMARY OF THE INVENTION

In keeping with an aspect of the invention, an indicator solution may be applied to the plastic or plastic fabric without causing any change in the color thereof. For example, if a fashion doll has untreated blond hair, it will continue to have substantially the same color of blond hair after the child applies the indicator solution to it. The child plays with the toy until the "let's pretend" time comes. Then, the child sprays the hair with a mist of a developer solution and the hair becomes another color. The developer solution may be basic or acidic depending upon the type of indicator dye in the indicator solution. As the hair dries, the original color returns. After the child tires of this color change, she shampoos the doll's hair and applies another kind of indicator solution for making a different color change.

In an alternative embodiment of the present invention, the indicator solution is impregnated in the plastic or plastic fabric. For example, if a fashion doll has pre-treated blond hair, the child simply plays with the toy until he or she decides to change its hair color. The child then applies a developer solution to the doll's hair, thereby causing the color change. As the hair dries and the developer solution evaporates, the hair returns to its original color.

BRIEF DESCRIPTION OF DRAWINGS

A preferred embodiment of the invention is seen in the attached drawing, wherein.

DETAILED DESCRIPTION OF THE INVENTION

In greater detail, the fashion doll 20 has relatively long blond hair 22, in this example. This hair is made of a suitable plastic fiber which is often used to make such doll hair.

Figure 1:
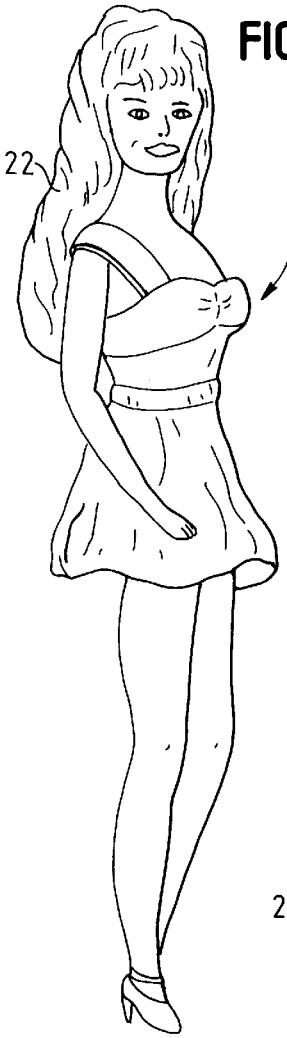
FIG. 1 is a perspective view of a fashion doll with an original blond color of hair.
Figure 2:
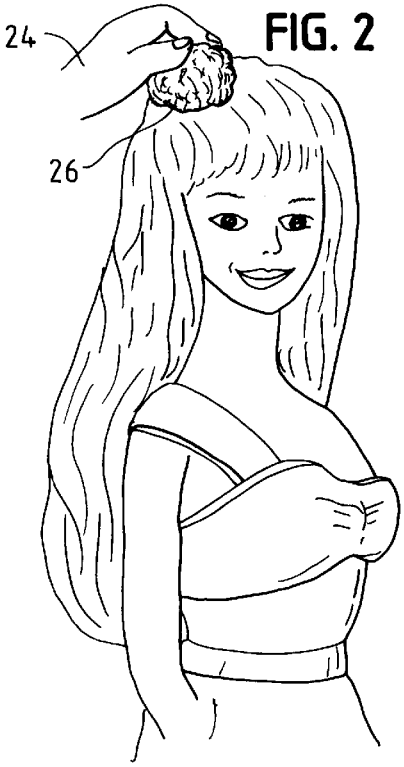
FIG. 2 is a fragment of the doll of FIG. 1 with the indicator solution being applied to the hair.

In FIG. 2, the child 24 is applying the indicator solution 26 to the doll's hair. The doll's hair retains its original color in the area where the indicator solution is applied.

A convenient indicator solution may contain the following ingredients:

a) cetyl alcohol;

b) polyethylene glycol;

c) sodium chloride;

d) phenolphthalein;

e) emulsifier; and f) distilled water.

The levels of these ingredients may easily be determined by one skilled in the art.

Phenolphthalein is the key component in the above indicator solution. It is utilized as an indicator because it is colorless in an acidic solution, but red in a basic solution. Thus, the phenolphthalein in the indicator solution is basically clear, but when a basic developer solution is applied, a pink/red color is brought out. While phenolphthalein is used here by way of example to illustrate the present invention, any other commercially available indicator dyes that go from being colorless to some color when the pH is changed may also be used.

Figure 3:
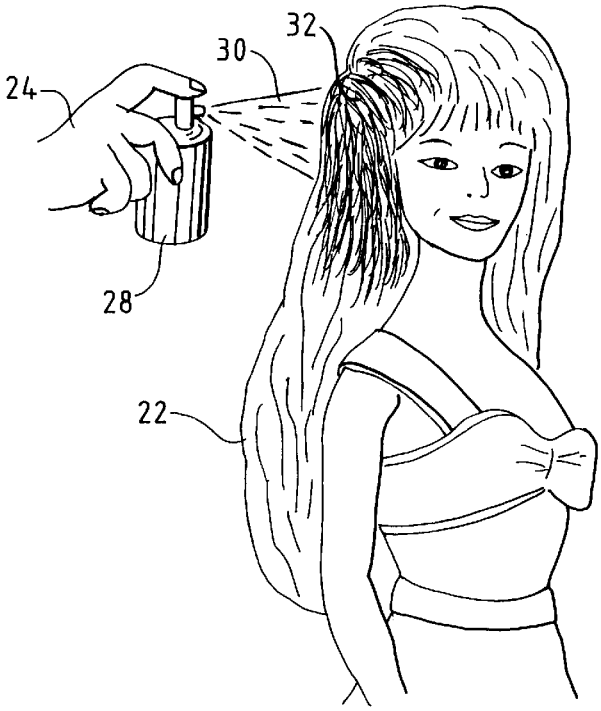
FIG. 3 is substantially the same fragment of the doll with a spray of a developer solution changing the color of the doll's hair.

At a later time, as shown in FIG. 3, the child 24 uses a spray can 28 with a finger operated, pump to direct the developer solution in the form of a spray or mist 30 toward the hair 22. The developer solution may also be applied by other suitable means, such as by a squeeze bottle. In those areas 32, which have become wet, the hair has changed color. This color change will remain as long as the hair is wet. The hair will revert to its original color when it dries. A suitable basic developer solution may contain the following ingredients:

a) potassium chloride;

b) sodium hydroxide;

c) distilled water; and d) phosphate.

Again, the levels of the ingredients of the developer may be readily determined by one skilled in the art. The developer evaporates after a suitable time period and the hair returns from its changed color to its original color.

The phenolphthalein is the active ingredient in the above indicator solution. It is essentially clear in the indicator solution at its pH value of about 8.2. However, when the basic developer solution at a pH value of about 11 to 13 is applied to the hair, a color change occurs. As the hair dries, the phenolphthalein returns to its clear state because the water in the basic developer solution which supplies hydrogen ions to create the chemical bonding between the indicator and developer solutions (and hence the color change) evaporates.

The length of time required for the color to return to normal depends at least somewhat upon the prevailing humidity. However, with the foregoing materials, a color change period of approximately one-half hour is a reasonable expectation. As long as the indicator solution remains on the plastic, an application of the basic developer spray continues to produce a temporary color change.

While the period of time the indicator solution stays on the plastic may change with such things as combing a fashion doll's hair, for example, a day or two is a reasonable expectation for the indicator solution to remain in a quantity that makes a color change possible.

If the child playing with the doll, for example, wishes to do so, the indicator solution may be washed out of the hair at any time, thus ending the period during which a hair color change may be accomplished by spraying the developer solution on it.

The principles of this invention may be expanded to apply, not only to plastic hair and fabric, but also to many different kinds of plastic surfaces.

Those who are skilled in the art will readily perceive how to modify the invention. Therefore, while the present invention is described above in connection with preferred or illustrative embodiments, the embodiments are not intended to be exhaustive or limiting of the invention. Rather, the invention is intended to cover all alternatives, modifications and equivalents included within its spirit and scope, as defined by the appended claims.

The invention claimed is:

1. A process for achieving a temporary color change on the surface of a plastic article, the process comprising the steps of:

a) applying an indicator solution to a surface of a plastic article to provide a temporary coating on the plastic surface, the indicator solution being capable of being washed off of the surface of the plastic article;

b) applying a developer solution to the plastic surface to provide a temporary color change on the plastic surface; and c) returning the surface of the plastic article to its original color by either waiting a period of time sufficient for the developer solution to evaporate from the surface of the plastic article or washing the indicator and developer from the surface of the plastic article.

2. The process of claim 1 wherein the plastic article is a fabric.

3. The process of claim 1 wherein the plastic article is synthetic hair.

4. The process of claim 1 wherein the indicator solution includes phenolphthalein.

5. The process of claim 1 wherein the indicator solution comprises the following ingredients: cetyl alcohol; polyethylene glycol; sodium chloride; phenolphthalein; emulsifier; and distilled water.

6. The process of claim 1 wherein the developer solution is acidic and the indicator solution takes on a color upon application of the developer solution.

7. The process of claim 1 wherein the developer solution is basic and the indicator solution takes on a color upon application of the developer solution.

8. The process of claim 7 wherein the basic developer solution includes sodium hydroxide.

9. The process of claim 7 wherein the basic developer solution comprises the following ingredients: potassium chloride; sodium hydroxide; distilled water; and phosphate.

10. A doll having plastic fiber hair of a predetermined color, an indicator solution applied to the plastic fiber hair to provide a temporary coating on the hair, the indicator solution being capable of being washed off of the surface of the plastic article, or changed in color by applying a developer solution whereby the hair can be returned to its original color by either waiting a period of time sufficient for the developer solution to evaporate from the surface of the hair or by washing the indicator and developer from the surface of the hair.

11. A plastic fiber hair of a predetermined color having an indicator solution on its surface, the indicator solution being capable of being washed off of the surface of the hair, whereby applying a developer solution to the hair will provide a temporary color change and the hair can be returned to its original color by waiting a period of time sufficient for the developer solution to evaporate.

12. The plastic fiber hair of claim 11 wherein the indicator solution comprising the following ingredients: cetyl alcohol; polyethylene glycol; sodium chloride; phenolphthalein; emulsifier; and distilled water.

* * * * *